US009842482B2

(12) United States Patent
Shirakawa et al.

(10) Patent No.: US 9,842,482 B2
(45) Date of Patent: Dec. 12, 2017

(54) SIGNAL DETECTING DEVICE

(71) Applicant: Hitachi Metals, Ltd., Tokyo (JP)

(72) Inventors: Yohei Shirakawa, Hitachi (JP); Koki Hirano, Hitachinaka (JP); Yoshitake Ageishi, Hitachi (JP); Yuki Haga, Takahagi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 15/249,106

(22) Filed: Aug. 26, 2016

(65) Prior Publication Data

US 2017/0061769 A1 Mar. 2, 2017

(30) Foreign Application Priority Data

Aug. 31, 2015 (JP) ..... 2015-170023

(51) Int. Cl.
*G08B 21/00* (2006.01)
*G08B 21/18* (2006.01)
*G08B 5/36* (2006.01)

(52) U.S. Cl.
CPC ..... *G08B 21/18* (2013.01); *G08B 5/36* (2013.01)

(58) Field of Classification Search
CPC ..... G08B 21/18; G08B 5/36; H04L 29/06; H04L 12/413; H04L 12/10; H04B 10/07; G01R 19/145; G06F 17/3087; G06F 1/3203
USPC ..... 340/687, 635, 645, 657, 651
See application file for complete search history.

(56) References Cited

U.S. PATENT DOCUMENTS 5,298,888 A * 3/1994 McEachern ..... G01R 23/165 324/107
5,504,811 A * 4/1996 Kiko ..... H04B 3/36 379/345
7,603,570 B2 * 10/2009 Schindler ..... G06F 1/3203 713/300
7,705,741 B2 * 4/2010 Picard ..... G01R 31/021 340/652
8,415,955 B2 * 4/2013 Devine ..... G01R 19/145 324/500
8,935,543 B2 * 1/2015 Hunter, Jr. ..... H04L 12/10 307/18
2016/0134508 A1 * 5/2016 Maness ..... H04L 43/12 709/224

FOREIGN PATENT DOCUMENTS

JP 2012-508956 A 4/2012
WO WO 2010/056821 A1 5/2010

* cited by examiner

*Primary Examiner* — Anh V La
(74) *Attorney, Agent, or Firm* — McGinn IP Law Group, PLLC

(57) ABSTRACT

A signal detecting device includes a visualization device including a plural connectors to which a communication cable is connected, a plural detecting circuits that are provided for each of the connectors to be detected, branch and extract a part of a signal transmitted through the communication cable connected to the connectors, and indicate an existence of an data communication based on the extracted signal, and a detecting card that is insertable into and detachable from a card connector arranged in the visualization device and mounts at least a part of the detecting circuit.

6 Claims, 5 Drawing Sheets

SIGNAL DETECTING DEVICE

The present application is based on Japanese patent application No. 2015-170023 filed on Aug. 31, 2015, the entire contents of which are incorporated herein by reference.

BACKGROUND OF THE INVENTION

1. Field of the Invention

The invention relates to a signal detecting device.

2. Description of the Related Art

In data centers etc., connection of communication cables such as LAN (local area network) cables is altered in accordance with layout change, displacement or addition of information and communication status equipment such as servers or hubs.

An information and communication equipment have a connection check lamp for checking connection of communication cables so that it is possible to determine whether or not a communication cable is connected.

Also an equipment has been proposed in which connection of a communication cable is monitored by detecting insertion and removal of a connector of the communication cable (see e.g., JP-A-2012-508956)

SUMMARY OF THE INVENTION

The prior arts only allow physical connection of the communication cable to be checked and has a problem that it is not possible to check whether or not communication is actually being performed through the communication cable, i.e., it is not possible to check the data communication state.

It is therefore considered that workers or users may pull out the communication cable by mistake without noticing that it is in the process of communication, causing failures such as shutdown of the information communication equipment or corruption of data during transfer. Accidental removal of communication cable leads to serious loss (causes serious risk) especially in case of major lines, etc., in data centers.

Also, in the data centers, many signal detecting devices to detect the existence of the information transmission may need. It is desirable to decrease the cost and to simplify the process for confirming the existence of the data communication.

It is an object of the invention to provide a signal detecting device that indicates the existence of data communication so as to prevent the accidental removal of communication cable, decreases the cost, and allows easy confirmation of the existence of the data communication.

According to an embodiment of the invention, a signal detecting device comprises:

a visualization device comprising a plurality of connectors to which a communication cable is connected;

a plurality of detecting circuits that are provided for each of the connectors to be detected, branch and extract a part of a signal transmitted through the communication cable connected to the connectors, and indicate an existence of an data communication based on the extracted signal; and a detecting card that is insertable into and detachable from a card connector arranged in the visualization device and mounts at least a part of the detecting circuit.

Effects of the Invention

According to an embodiment of the invention, a signal detecting device can be provided that that indicates the existence of data communication so as to prevent the accidental removal of communication cable, decreases the cost and allows easy confirmation of the existence of the data communication.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Embodiment

An embodiment of the invention will be described below with the appended drawings.

Figure 1A:
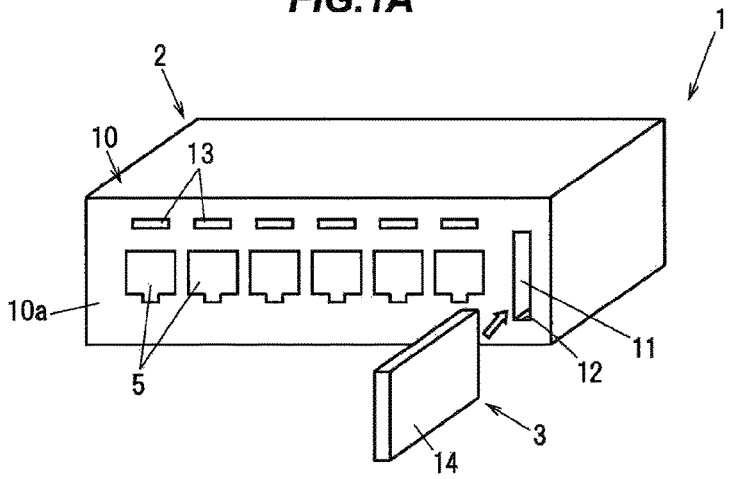
FIG. 1A is a perspective view showing an appearance of a signal detecting device in an embodiment according to the invention.
Figure 1B:
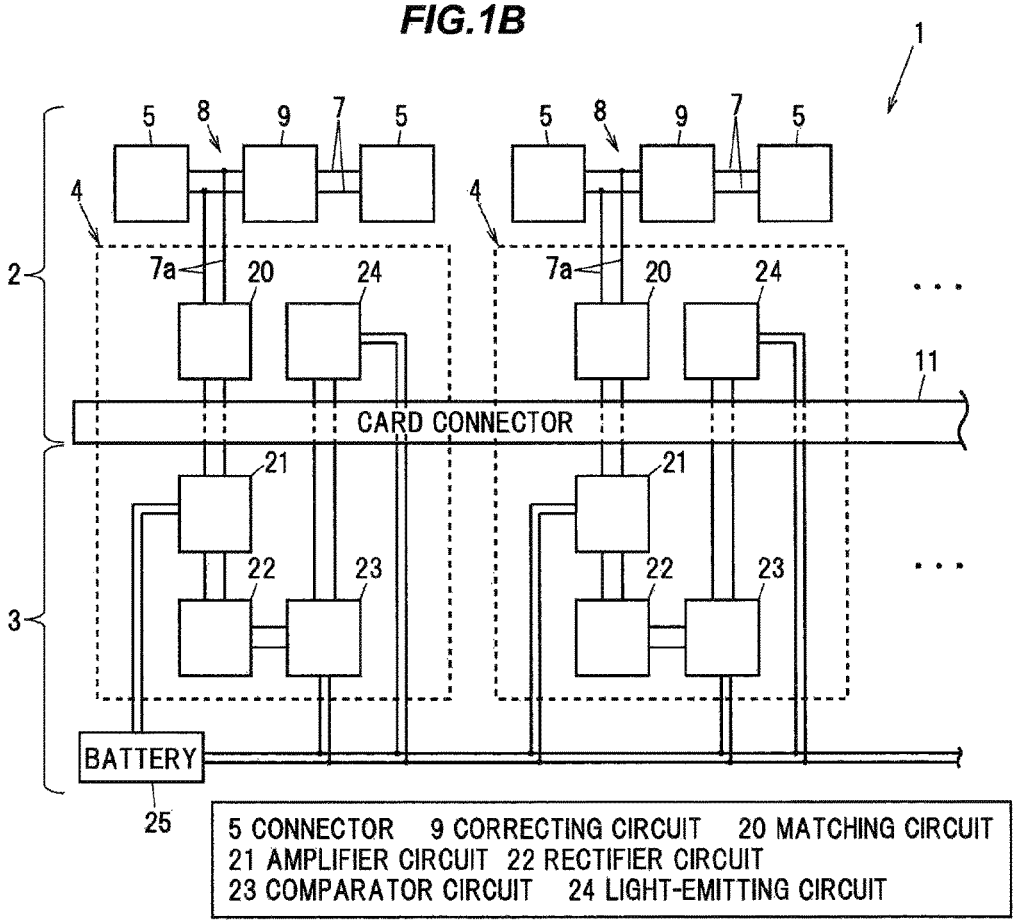
FIG. 1B is a schematic block diagram showing a signal detecting device in an embodiment according to the invention.
Figure 2A:
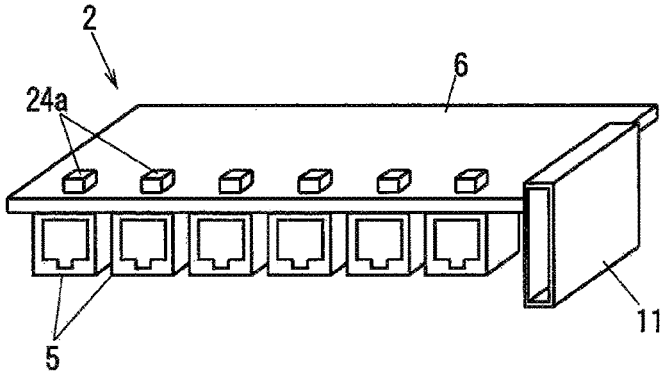
FIG. 2A is a perspective view showing a visualization device without a housing in the signal detecting device in FIG. 1A.
Figure 2B:
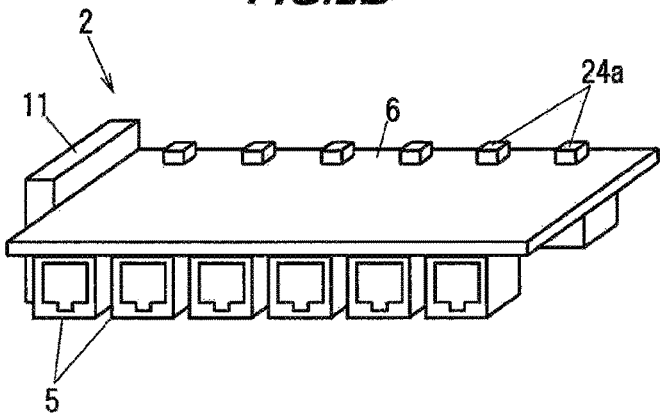
FIG. 2B is a perspective view showing a visualization device without a housing in the signal detecting device in FIG. 1A.
Figure 3:
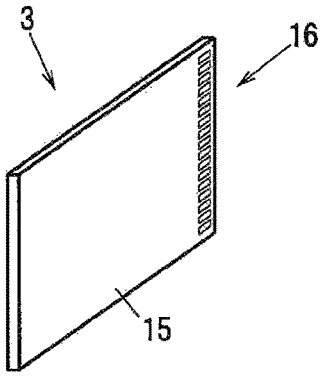
FIG. 3 is a perspective view showing a card circuit board in the signal detecting device in FIG. 1A.
Figure 4A:
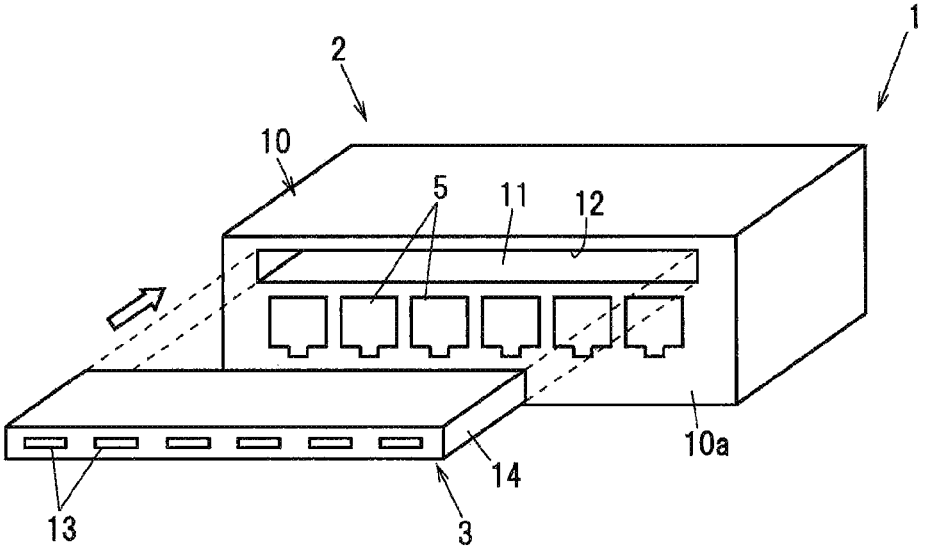
FIG. 4A is a perspective view showing an appearance of a signal detecting device in an alternative embodiment according to the invention.
Figure 4B:
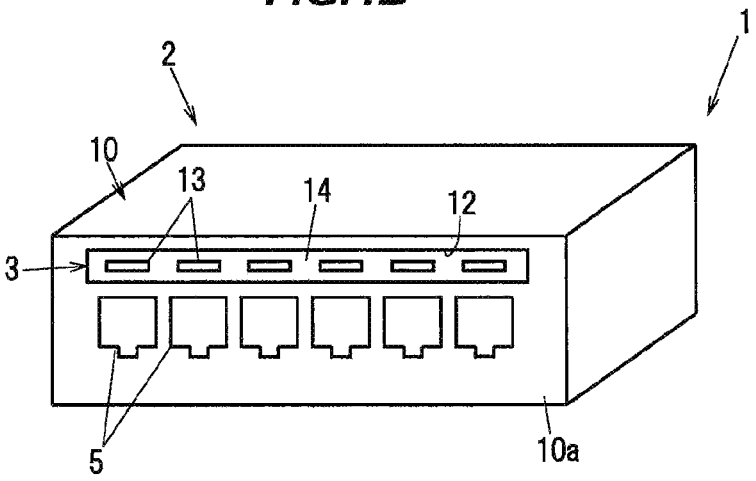
FIG. 4B is a perspective view showing an appearance of a signal detecting device in an alternative embodiment according to the invention.
Figure 5:
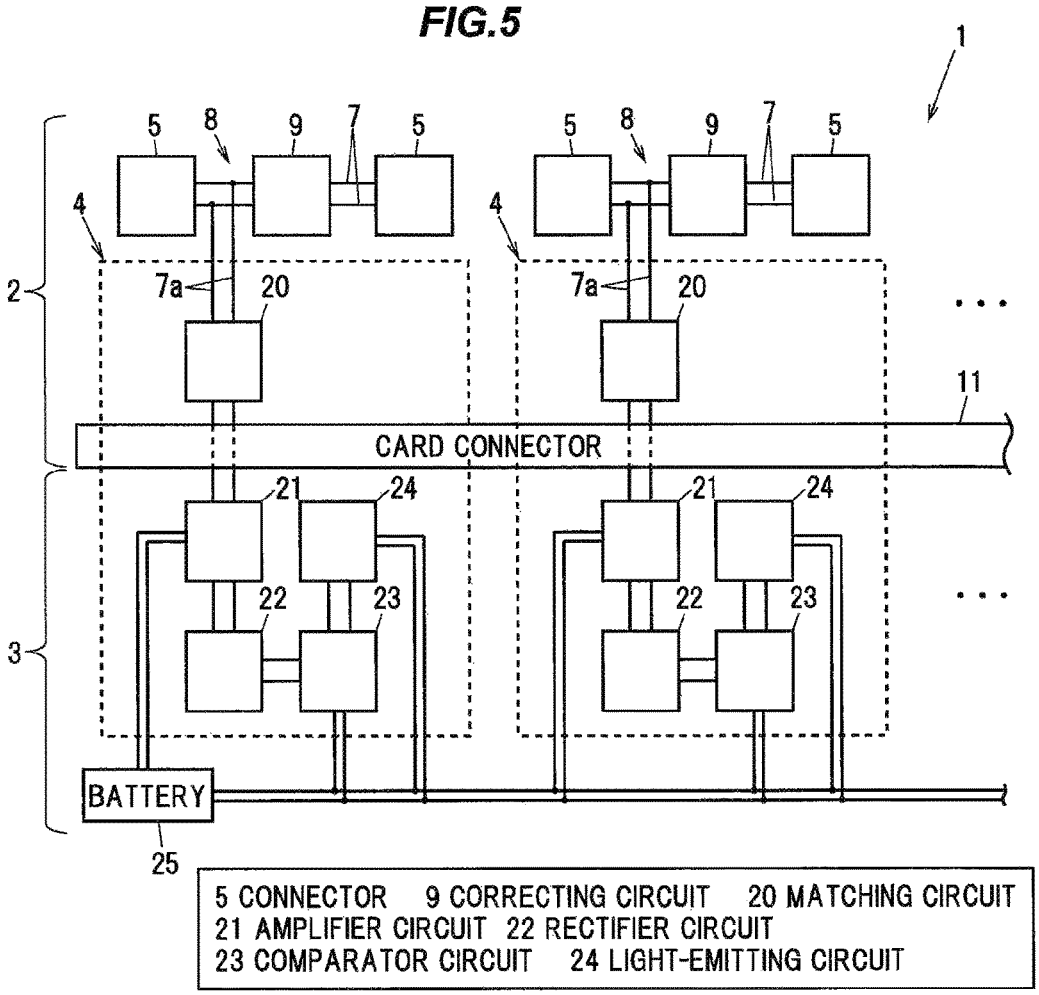
FIG. 5 is a schematic block diagram showing a signal detecting device in FIGS. 4A, 4B.
Figure 6:
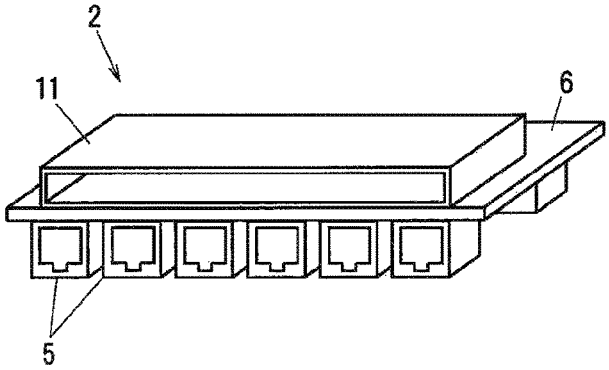
FIG. 6 is a perspective view showing a visualization device without a housing in the signal detecting device in FIG. 4A, 4B.
Figure 7:
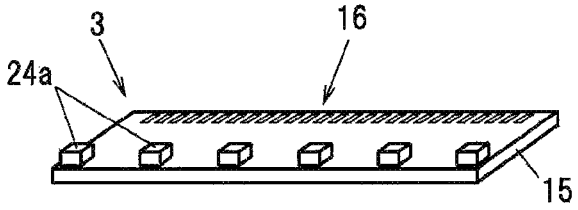
FIG. 7 is a perspective view showing a card circuit board in the signal detecting device in FIGS. 4A, 4B.

FIG. 1A is a perspective view showing an appearance of a signal detecting device in an embodiment according to the invention. FIG. 1B is a schematic block diagram showing a signal detecting device in an embodiment according to the invention. FIG. 2A is a perspective view showing a visualization device without a housing in the signal detecting device in FIG. 1A. FIG. 2B is a perspective view showing a visualization device without a housing in the signal detecting device in FIG. 1A. FIG. 3 is a perspective view showing a card circuit board in the signal detecting device in FIG. 1A As shown in FIG. 1A to FIG. 3, a signal detecting device 1 is provided with a visualization device 2 and a detecting card 3 and a plurality of detecting circuits 4, which are mounted on the visualization device 2 and the detecting card 3.

(Explanation of the Visualization Device 2)

The visualization device 2 has a plurality of connectors 5 to connect communication cable (not shown) to transmit a differential signal.

As with the communication cable, a cable commonly used as a LAN (local area network) cable can be used as the communication cable. In the present embodiment, it is used as a cable having four pairs (i.e. eight in total) of the signal lines transmitting the differential signal.

In the present embodiment, the visualization device 2 is provided with a plurality pair of the connectors 5 and configured so as to connect each of the communication cables connected to the pair of the connector 5. That is, the visualization device 2 is a communication device called a repeater or a patch panel. The connector 5 is, for example, a jack connector standardized as RJ45, and configured so as to be connectable to a connector arranged at an end of the communication cable (for example, a plug connector standardized RJ45).

The connector 5 is mounted on a circuit board 6. In the present embodiment, as a communication cable having four pairs of the signal lines transmitting a differential signal is used, a signal transmitting section 8 having four pairs of transmission lines 7 corresponding to the four pairs of the signal lines are formed respectively between the connectors 5 making the pair. The transmission line 7 is formed so as to connect each terminals corresponding to the connectors 5 making the pair.

The signal transmission section 8 is mounted on the circuit board 6. In the present embodiment, the signal transmission section 8 provides a correcting circuit 9 to correct a pair-to-pair crosstalk caused at the connector 5.

In this embodiment, while it is explained that in case of the visualization device 2 having six pairs of the connectors 5, a number of the connector 5 is not limited to thereof. Also in this embodiment, while it is explained that in case of the visualization device 2 serving a function as the repeater (patch panel), the visualization device 2 may be a part of the other communication device such as the part of a network switch or a server, and it is allowed to the connector 5 not having pair.

The visualization device 2 is provided with a housing 10 having a front panel 10*a* which is an approximately rectangular, and configured so as to commit the circuit board 6 in the housing 10. Below, horizontal direction in FIG. 1A calls width direction, vertically direction in FIG. 1A calls a height direction, and left front to right back direction calls depth direction.

The six connectors 5 are arranged in line in the width direction in the front panel 10*a*. The six connectors 5 configuring pairs with the six connectors 5 arranged at the side of the front panel 10*a* are arranged in line in the width direction on a rear panel (not shown) that is opposite to the front panel 10.

Also, a card connector 11 to insert the detecting card 3 is mounted on the circuit board 6 in the visualization device 2. Although this embodiment shows the card connector arranged at the end of the circuit board 6 in the width direction (the right end shown in FIG. 2A), an arrangement of the card connector 11 can suitably change. A slot 12 to insert the detecting card 3 into the card connector 11 is arranged at the front panel 10*a*. In the present embodiment, the detecting card 3 is inserted into the card connector 11 from a side of the front panel 10 to along with the depth direction.

A light-emitting element 24A (LED) on a light-emitting circuit 24 described below are mounted on the circuit board 6 in the visualization device 2. The light-emitting element 24A is arranged at the end of the side of the front panel 10*a* of the circuit board so as to show a light-emitting section for the side of the front panel 10*a*. The light-emitting element 24A are arranged at upside of the connector 5 arranged at the side of the front panel 10*a* (an opposite position through the circuit board 6) respectively. In the opposite position from the light-emitting element 24A in the front panel 10*a*, light-emitting sections 13 to confirm emitting the light-emitting element 24A are arranged respectively.

(Explanation of the Detecting Card 3)

A detecting card 3 is arranged with freely inserted in and pulled out in the card connector 11 arranged at the visualization device 2 and mount at least a part of each detecting circuits 4. Explanation of the detecting circuit 4 will be described below.

The detecting card 3 is provided with a housing 14 having an approximately rectangular that opens forwardly in the insertion and the detecting card circuit board 15 committed in the housing 14, that is formed card-shaped (plane-shaped) totally. The detecting card circuit board mounts a part of the detecting circuit described below.

A card edge connector 16 is formed by aligning the electrodes (pads) at the forward end in the insertion of the detecting card circuit board 15. According to inserting the detecting card 3 into the card connector 11, each of the electrodes in the card edge connector 16 are connected electrically with connecting terminals (not shown) in the card connector 11. The detecting card circuit board 15 connects electrically the circuit board 6 in the visualization device 2.

(Explanation of the Detecting Circuit 4)

The detecting circuit 4 is arranged by the connector 5 to be subject to detecting respectively. The detecting circuit 4 branches and extracts a part of the signal transmitting in the communication cable connected to the connector 5 and indicates existence of the data communication based on the extracted signal. In this case, since the visualization device 2 provides six pairs of the connectors 5, the six detecting circuits 4 are totally provided for the pairs. Furthermore, FIG. 1B shows only two of the detecting circuits 4.

Each of the detecting circuits 4 is composed of a matching circuit 20, an amplifier circuit 21, a rectifier circuit 22, a comparator circuit 23 and a light-emitting circuit 24 which are connected sequentially.

The matching circuit 20 is to provide impedance matching in a predetermined frequency band. In the present embodiment, since a portion of a signal transmitted through the communication cable is branched and extracted, the matching circuit 20 also serves to adjust the level of a signal extracted from the communication cable.

In the present embodiment, branch transmission lines 7*a* branched from any pair of the transmission lines 7 in corresponding to between the pair of the connectors 5 inputs into the matching circuit 20 in the detecting circuit 20. The matching circuit 20 is constructed from, for example, a resistive circuit.

The amplifier circuit 21 is a circuit which amplifies the signal extracted from a given signal line of the communication cable (the transmission line 7) through the matching circuit 20 and outputs the amplified signal to the downstream rectifier circuit 22. As the amplifier circuit 21, it is possible to use, e.g., a grounded emitter circuit. However, the specific configuration of the amplifier circuit 21 is not limited thereto. Although the amplifier circuit 21 is a single-stage configuration in the present embodiment, the amplifier circuit 21 may be a multistage configuration.

The comparator circuit 23 is a circuit which is turned on and outputs the DC signal with a predetermined voltage to the downstream light-emitting circuit 24 when the output voltage of the rectifier circuit 22 is not less than a preset threshold voltage (offset voltage).

The comparator circuit 23 is a circuit which is turned on and outputs the DC signal with a predetermined voltage to the downstream light-emitting circuit 24 when the output voltage of the rectifier circuit 22 is not less than a preset threshold voltage (offset voltage).

Providing the comparator circuit 23 allows a signal with a constant voltage to be output to the light-emitting circuit 24 even when the output voltage of the rectifier circuit 22 is small as long as offset voltage of the comparator 23 is set to a low level, and it is thereby possible to stably operate the light-emitting circuit 24. Therefore, it is possible to reduce the level of the signal extracted from the communication cable by increasing the resistance value of resistors Rin of the matching circuit 20, which reduces reflection loss and insertion loss and thus suppresses deterioration in quality of the signal transmitted through the communication cable.

Also, strength of the signal transmitted through the communication cable may be different depending on a communication device connected to the communication cable or length of the communication cable. However, since the comparator circuit 23 is provided, it is possible to stably operate the light-emitting circuit 24 even when the strength of the signal transmitted through the communication cable is small. Furthermore, since the output voltage of the rectifier circuit 22 can be reduced, it is possible to reduce output voltage of the amplifier circuit 21, to lower power consumption, and even to suppress deterioration in signal quality caused because the output signal of the amplifier circuit 21 enters the communication cable.

The light-emitting circuit 24 is provided with the light-emitting element 24A such as an LED (light emitting device) and indicates existence of the data communication using emitting the light-emitting element 24A based on output from the comparator circuit 23. In the present embodiment, the light-emitting circuit 24 is provided so as to emit the light-emitting element 24A in output from the comparator circuit 23 turning on. That is, the light-emitting element 24A emits in the comparator circuit 23 outputting the predetermined voltage signal.

Furthermore, the configuration of the light-emitting circuit 24 is not limited to thereof, for example, the light-emitting circuit 24 may be provided with two light-emitting elements (LED) and indicate the existence of the data communication by the different two emitting colors. More specifically, for example, the blue light-emitting element emits when the light-emitting circuit 24 receive the data communication status (the comparator circuit 23 turns on), and the red light-emitting element emits when the light-emitting element does not receive the data communication status (the comparator circuit 23 turns off).

In the signal detecting device 1 in the present embodiment, the matching circuits 20 and the light-emitting circuits 24 corresponding to each of the detecting circuits 4 are mounted on the visualization device 2 and the amplifier circuits 21 and the rectifier circuits 22 corresponding to each of the detecting circuits 4 are mounted on the detecting card 3.

The matching circuits 20 and the light-emitting circuits 24 corresponding to each of the detecting circuits 4 are mounted on the circuit board 6 of the visualization device 2 and the amplifier circuits 21 and the rectifier circuits 22 corresponding to each of the detecting circuits 4 are mounted on the detecting card circuit board 15 of the detecting card 3.

Output of the matching circuit 20 and input of the amplifier circuit 21, and output of the comparator circuit 23 and input of the light-emitting circuit 24 are connected electrically through the card connector 11 (and card edge connector 16).

The detecting card 3 is not needed to be provided with each of the visualization devices 2. The detecting card 3 can be used by a plurality of the visualization devices 2 commonly. Thus, According to mounting a part of each of the detecting circuits 4 (in this case, the amplifier circuit 21, the rectifier circuit 22 and the comparator circuit 23) that is mounted on the detecting card 3 and the number of the detecting card 3 that is less than the number of the visualization device 2, the cost of whole system can decrease. That is, it is not needed to mount all configuration of the detecting circuit 4 on each of the visualization devices 2 and can become the cost of the whole system decrease. Also, the visualization device 2 can downsize comparing with the visualization device 2 on which all configurations of the detecting circuit 4 mounts.

Also, in the present embodiment, according to confirming the existent of the data communication status by only inserting the detecting card 3 into the card connector 11, it is easy to confirm the data communication status. As the detecting card 3 is formed in card shaped, the operator is easy to take the detecting card 3 along.

Moreover, according to mounting the amplifier circuit 21 on the detecting card 3, it is possible to suppress deterioration in signal quality caused because the output signal of the amplifier circuit 21 enters the communication cable.

In the present embodiment, furthermore, the battery 25 for supplying power to each of the detecting circuits 4 are mounted on the detecting card 3, each of the detecting circuit 4 are provided so as to supply power to the amplifier circuits 21, the comparator circuits 23 and the light-emitting circuits 24 in each of the detecting circuits from the battery 25. In the present embodiment, as the light-emitting circuit 24 is mounted on the visualization device 2 side, the power from the battery 25 is supplied to the light-emitting circuit 24 through the card connector 11 (and the card edge connector 16).

In the present embodiment, as the card connector 11 is arranged at one side of the circuit board 6 in the width direction, the wiring distance from the card connector 11 to the connector 5 that is arranged at the opposite side of the card connector 11 become long. Consequently, a wiring connecting output of the matching circuit 20 and input of the amplifier circuit 21, and output of the comparator circuit 23 and input of the light-emitting circuit 24 become long and are possibility to be affected by noise. It is preferable to use shielding wiring such that have strip configuration for the wiring between output of the matching circuit 20 and input of the amplifier circuit 21, and output of the comparator circuit 23 and input of the light-emitting circuit 24. In this case, a multi-layer board is used for the circuit board 6. The wiring layer sandwiched by ground layers formed at inner layers is used for the wiring between output of the matching circuit 20 and input of the amplifier circuit 21, and output of the comparator circuit 23 and input of the light-emitting circuit 24.

Also, in the present embodiment, as the amplifier circuit 21, the rectifier circuit 22 and the comparator circuit 23 that are provided with each of the detecting circuits 4 are mounted on the detecting card 3, it is not limited to thereof, any one or two of the amplifier circuit 21, the rectifier circuit 22 and the comparator circuit 23 may be provided so as to be mounted on the detecting card 3. However, it is desirable to mount the circuits as much as possible on the detecting card 3 from the view of decreasing cost of making the signal detecting device 1.

Besides, the light-emitting circuit 24 provided with each of the detecting circuits 4 may be mounted on the detecting card 3.

In this case, as shown in FIG. 4A to FIG. 7, the light-emitting section 13 is arranged at the detecting card 3. Thus, it is needed to choose the insertion position of the detecting card 3 etc. for ease to confirming each of the light-emitting sections 13 corresponding to the connectors 5.

In this case, the card connector 11 is mounted on the upper surface of the circuit board 6 (the opposite surface of the connector 5 mounted) and the slots 12 are formed on upside of six of the connector 5 arranged at the front panel 10*a* in line. The slot 12 is configured such that the detecting card 3 is inserted into the slot 12.

The light-emitting element 24A is arranged at the opposite end of the card edge connector 16 of the detecting card circuit board 15 (a back end section in the direction of the detecting card 3 insertion) so as to face the light-emitting section 13 and back of insert direction. The light-emitting section 13 to confirm emitting corresponding to the light-emitting element 24A are arranged at the back end in the insert direction of the housing 14 of the detecting card 3. The light-emitting section 13 are arranged separately in the width direction and arranged at such that locate at the upside of the corresponding connector 5 when the detecting card 3 is inserted into the card connector 11.

Besides, in the case, the signal detecting device 1 that is configured such that the detecting card 3 is inserted into the upside of the connector 5 is explained. The signal detecting device 1 may be configured such that the detecting card 3 is inserted into the bottom of the connector 5. In this case, the light-emitting sections 13 are arranged at the bottom of the corresponding connector 5.

As the amplifier circuits 21, the rectifier circuits 22 and the comparator circuits 23 in each of the detecting circuits 4 and then the light-emitting circuits 24 are mounted on the detecting card 3, the cost of the detecting card 3 can be decreased by increasing circuits mounted on the detecting circuit 3. Also, since supplying power from the battery 25 mounted on the detecting card 3 to the visualization device 2 is not needed, the configuration of the overall structure can be easier.

Also, as shown in FIG. 4A to FIG. 7, by configuring such that the upper surface of the circuit board 6 (opposite side surface on which the connector 5 is mounted) mounts the card connector 11, the wiring distance between the card connector 11 and each of the connector 5 become short. Thus, the wiring between output of the matching circuit 20 and input of the amplifier circuit 21 is hardly affected by the noise. The failure affected by the noise can be suppressed without using the wiring having strip structure.

Furthermore, although not shown, the matching circuit 20 of each of the detecting circuit 4 can be mounted on the detecting card 3. In this case, all configurations of the detecting circuit 4 are mounted on the detecting card and it makes possibility to decrease the cost.

(Functions and Effects of the Embodiment)

As described above, the signal detecting device 1 in the present embodiment is provided with a signal detecting device 1, which comprises a visualization device 2 having a plurality of connectors 5 to connect a communication cable, a plurality of detecting circuits 4 arranged at each of the connectors 5 to be subject to detecting, branching and extracting a part of signal transmitted in the communication cable connected to the connector 5, indicating the existence of data communication based on the extracted signal, and a detecting card 3 arranged at a card connector 11 arranged in the visualization device 2 freely inserted in and pulled out, mounting at least a part of the detecting circuit 4.

According to configuring the detecting circuit 4, it is possible to determine whether or not a communication cable is connected and suppress miss-removing of the communication cable. Since a communication cable without the data communication status is easily confirmed by using the detecting circuit 4, the work efficiency in removing the communication cable increases.

Also, mounting a part of the detecting circuit 4 on the detecting card 3, a part of the detecting circuit 4 can be shared by a plurality of the visualization devices 2 and it is possible to decrease the cost.

Moreover, since in the present embodiment the existence of data communication can be detected only by inserting the detecting card 3 into the visualization device 2, it is easy to confirm the existence of data communication. Also, since the detecting card 3 is card-shaped, it is not bulky comparing with e.g., having a box shaped, and the operator can carry it easily.

SUMMARY OF THE EMBODIMENTS

Technical ideas understood from the embodiment will be described below citing the reference numerals, etc., used for the embodiment. However, each reference numeral, etc., described below is not intended to limit the constituent elements in the claims to the members, etc., specifically described in the embodiment.

[1] A signal detecting device (1), comprising: a visualization device (2) comprising a plurality of connectors (5) to which a communication cable is connected; a plurality of detecting circuits (4) that are provided for each of the connectors (5) to be detected, branch and extract a part of signal transmitted through the communication cable connected to the connectors (5), and indicate an existence of data communication based on the extracted signal; and a detecting card (3) that is insertable into and detachable from a card connector (11) arranged in the visualization device (2) and mounts at least a part of the detecting circuit (4).

[2] The signal detecting device (1) according to [1], wherein each of the detecting circuits (4) comprises an amplifier circuit (21) that amplifies and outputs a signal by branching and extracting a part of the signal transmitted through the communication cable, and wherein the amplifier circuit (21) of each of the detecting circuits (4) is mounted on the detecting card (3).

[3] The signal detecting device (1) according to [1], wherein each of the detecting circuits (4) comprises a rectifier circuit (22) that rectifies and outputs the signal by branching and extracting a part of the signal transmitted through the communication cable, and wherein the rectifier circuit (22) of each of the detecting circuits is mounted on the detecting card.

[4] The signal detecting device (1) according to [1], wherein each of the detecting circuits (4) comprises a comparator circuit (23) that outputs a direct current signal having a predetermined voltage when an output voltage from the amplifier circuit (22) is not less than a predetermined threshold voltage, and wherein the comparator circuit (23) of each of the detecting circuits (4) is mounted on the detecting card (3).

[5] The signal detecting device (1) according to [1], wherein each of the detecting circuits (4) comprises a battery (25) that supplies power, and wherein the battery (25) is mounted on the detecting card (3).

[6] The signal detecting device (1) according to [1], wherein each of the signal detecting circuits (4) comprises a light-emitting circuit (24) that indicates the existence of data communication by an emission of a light-emitting element, and wherein the light-emitting circuit (24) of each of the detecting circuits (4) is mounted on the detecting card (3).

[7] The signal detecting device (1) according to [6], comprising a housing (10) comprising a front panel (10*a*) on a front face, wherein at least a part of the plurality of connectors (5) is formed aligned in a width direction of the front panel (10*a*), wherein the front panel (10*a*) comprises a slot (12) for inserting the detecting card (3) into the card connector (11) above or under the plurality of connectors (5) arranged on the front panel (10*a*) in line, wherein the detecting card (3) comprises a plurality of light-emitting sections (13) to confirm emission of the light-emitting circuit (24) on a rear end face in an insert direction thereof, and wherein the light-emitting sections (13) are arranged separately in the width direction so as to locate above or under corresponding ones of the connectors (5) when inserting the detecting card (3) into the card connector (11).

[8] The signal detecting device (1) according to [1], comprising a plurality pairs of the connectors (5), and a transmission line (7) that allows a connection between the pairs of the connectors (5), wherein the detecting circuit (4) is provided for each of the pairs of the connectors (5), and wherein a branched transmission line (7*a*) branched from the transmission line (7) is connected to the detecting circuit (4).

Although the embodiment of the invention has been described, the invention according to claims is not to be limited to the embodiment. Further, please note that all combinations of the features described in the embodiment are not necessary to solve the problem of the invention.

The invention can be appropriately modified and implemented without departing from the gist thereof.

What is claimed is:

1. A signal detecting device, comprising:

a visualization device comprising a plurality of connectors to which a communication cable is connected;

a plurality of detecting circuits that are provided for each of the connectors to be detected, branch and extract a part of a signal transmitted through the communication cable connected to the connectors, and indicate an existence of an data communication based on the extracted signal; and a detecting card that is insertable into and detachable from a card connector arranged in the visualization device and mounts at least a part of the detecting circuit, wherein each of the signal detecting circuits comprises a light-emitting circuit that indicates the existence of data communication by an emission of a light-emitting element, and wherein the light-emitting circuit of each of the detecting circuits is mounted on the detecting card, the signal detecting device further comprising a housing comprising a front panel on a front face, wherein at least a part of the plurality of connectors is formed aligned in a width direction of the front panel, wherein the front panel comprises a slot for inserting the detecting card into the card connector above or under the plurality of connectors in the front panel, wherein the detecting card comprises a plurality of light-emitting sections to confirm emission of the light-emitting circuit on a rear end face in an insert direction thereof, and wherein the light-emitting sections are arranged separately in the width direction so as to locate above or under corresponding ones of the connectors when inserting the detecting card into the card connector.

2. The signal detecting device according to claim 1, wherein each of the detecting circuits comprises an amplifier circuit that amplifies and outputs a signal by branching and extracting a part of the signal transmitted through the communication cable, and wherein the amplifier circuit of each of the detecting circuits is mounted on the detecting card.

3. The signal detecting device according to claim 1, wherein each of the detecting circuits comprises a rectifier circuit that rectifies and outputs a signal by branching and extracting a part of the signal transmitted through the communication cable, and wherein the rectifier circuit of each of the detecting circuits is mounted on the detecting card.

4. The signal detecting device according to claim 1, wherein each of the detecting circuits comprises a comparator circuit that outputs a direct current signal having a predetermined voltage when an output voltage from the comparator circuit is not less than a predetermined threshold voltage, and wherein the comparator circuit of each of the detecting circuits is mounted on the detecting card.

5. The signal detecting device according to claim 1, wherein each of the detecting circuits comprises a battery that supplies power, and wherein the battery is mounted on the detecting card.

6. The signal detecting device according to claim 1, further comprising:

a plurality of pairs of the connectors; and a transmission line that allows a connection between the pairs of the connectors;

wherein the detecting circuit is provided for each of the pairs of the connectors, and wherein a branched transmission line branched from the transmission line is connected to the detecting circuit.

* * * * *